US006562774B2

(12) United States Patent
Bijl et al.

(10) Patent No.: US 6,562,774 B2
(45) **Date of Patent: *May 13, 2003**

(54) BLEACHING COMPOSITION

(75) Inventors: Dirk Johannes Bijl, Vlaardingen (NL); Ronald Hage, Vlaardingen (NL); Jan Kevelam, Vlaardingen (NL); Jean Hypolites Koek, Vlaardingen (NL); Dennis Stephen Murphy, Edgewater, NJ (US); Irene Erica Smit, Vlaardingen (NL); Johannes Jacob Verhagen, Vlaardingen (NL); Pieter Van Der Vlist, Vlaardingen (NL)

(73) Assignee: Unilever Home & Personal Case USA, division of Conopco, Inc., Greenwich, CT (US)

( * ) Notice: Subject to any disclaimer, the term of this patent is extended or adjusted under 35 U.S.C. 154(b) by 124 days.

This patent is subject to a terminal disclaimer.

(21) Appl. No.: 09/741,395

(22) Filed: Dec. 20, 2000

(65) Prior Publication Data

US 2001/0023236 A1 Sep. 20, 2001

(30) Foreign Application Priority Data

Dec. 23, 1999 (EP) ..... 99204518

(51) Int. Cl.[7] ..... C11D 1/82; C11D 3/20; C11D 3/39; C11D 3/395

(52) U.S. Cl. ..... 510/286; 510/303; 510/304; 510/309; 510/372; 510/375; 510/499; 510/466; 510/506

(58) Field of Search ..... 510/286, 303, 510/304, 309, 372, 375, 379, 380, 381, 466, 499, 506; 8/111, 142

(56) References Cited

U.S. PATENT DOCUMENTS

| | | | | |
|---|---|---|---|---|
| 4,300,897 | A | | 11/1981 | Gray |
| 5,431,843 | A | | 7/1995 | Mitchell et al. |
| 5,683,473 | A | | 11/1997 | Jureller et al. |
| 5,799,218 | A | * | 8/1998 | Alvarez et al. ..... 8/111 |

FOREIGN PATENT DOCUMENTS

| | | |
|---|---|---|
| DE | 39 06 735 | 3/1989 |
| WO | 98/23532 | 6/1998 |

* cited by examiner

*Primary Examiner*—Gregory Delcotto
(74) *Attorney, Agent, or Firm*—Milton L. Honig

(57) ABSTRACT

A bleaching composition is provided comprising
a) a bleach-effective amount of a low-active oxygen bleaching agent;
b) a bleach-compatible solvent
c) 0 to 10 wt % of a surfactant;
d) less than 10 wt % of a modifier; and
e) an effective dry cleaning amount of densified carbon dioxide, said composition being essentially free of carbon dioxide soluble organic peracid.

12 Claims, No Drawings

BLEACHING COMPOSITION

FIELD OF THE INVENTION

The present invention relates to the field of bleaching compositions to remove stains from articles, in particular textile articles. In addition the present invention relates to a method of preparing a bleaching composition and method to bleach articles.

BACKGROUND OF THE INVENTION

It is known in the art to use hydrogen peroxide or organic peracids or their precursors to remove stains from metal, ceramic, plastic or textile articles.

More recently, cleaning with carbon dioxide has been described. Dense phase carbon dioxide has been suggested as an alternative to perchloroethylene for health and environmental reasons. For example, a dry cleaning system in which chilled liquid carbon dioxide is used to extract soils from fabrics is described in U.S. Pat. No. 4,012,194.

However, it has been recognised that additives are needed to boost the cleaning by this medium. For example, the use of ethoxylated tertiary acetylenic alcohol and diol surfactants for boosting the cleaning performance from condensed phase carbon dioxide are taught in U.S. Pat. No. 5,789,505. U.S. Pat. No. 5,431,843 discloses a perhydrolysis system for use in condensed fluid medium for bleaching of stained garments. This perhydrolysis system comprises two essential components: hydrogen peroxide and an organic peracid precursor. The examples seem to indicate that a combination of hydrogen peroxide and nonanoyloxyglycoylphenyl sulfonate (NOGPS) results in a better overall stain removal when compared to hydrogen peroxide alone. To obtain these results, the bleaching process takes place for at least 1 hour. U.S. Pat. No. 5,676,705 describes the use of organic peracid precursor in a dry cleaning process using carbon dioxide. Herein, both the preformed peracids and the directly added organic peracid precursor should be soluble in densified carbon dioxide.

The use of low-active oxygen bleaching agents for removal of soil from garments in aqueous systems is known. U.S. Pat. No. 3,332,882 describes the use of such bleaching agents in combination with triazine activators. U.S. Pat. No. 4,300,897 discloses a method of bleaching using peroxomonosulfate-based compositions. WO-A-9923197 describes a process of soaking fabrics with a liquid aqueous persulfate salt-containing composition. And, WO-A-9921950 discloses the use of peroxonitrite based bleaching systems. However neither of these documents discloses or suggests to the skilled person that low-active oxygen bleaching agent could be effective in a bleaching method wherein the medium is mainly carbon dioxide. U.S. Pat. No. 5,431,843 only exemplifies the use of liquid hydrogen peroxide in combination with an organic peracid precursor. For bleaching in carbon dioxide persulfate is mentioned as possible sources of peroxygen but only in combination with an organic peracid precursor. There is no disclosure or suggestion for the skilled person that an low-active oxygen bleaching agent alone would have an effective bleaching effect.

Although organic peracids and/or precursor systems are generally effective they still exhibit several disadvantages. For example, these precursor systems have large formulation space requirements as they also need addition of hydrogen peroxide and/or a hydrogen peroxide delivery system. Consequently, a significant proportion of the cleaning formulation must be devoted to the bleach components, leaving less room for other active ingredients and complicating the development of concentrated formulations. Furthermore, the efficacy of bleaching systems that are based on hydrogen peroxide tend to be adversely affected by catalase present in soiled articles. Moreover, organic precursor systems do not bleach very efficiently in situations wherein short bleach times are desired and processing environment is acidic or pH neutral.

Accordingly, it is an object of the invention to provide an alternative bleaching composition and method of bleaching which shows effective stain removal but does not display one or more of these drawbacks. One particular object of the invention is to provide a bleaching composition and method of bleaching which are economical and require short bleach times. Another object of the invention is to provide a bleaching composition and a method of bleaching which are particularly suitable for removing grass, tea and blackcurrant stains.

Surprisingly, we have now found that one or more of these objects can be achieved by the inventive bleaching composition and method of bleaching which are substantially free of carbon dioxide-soluble organic peracid and still show a remarkably effective stain removal.

DEFINITION OF THE INVENTION

Accordingly, in a first aspect of the invention a bleaching composition is provided comprising a) a bleach-effective amount of a low-active oxygen bleaching agent;
b) a bleach-compatible solvent
c) 0 to 10 wt % of a surfactant;
d) less than 10 wt % of a modifier; and
e) an effective dry cleaning amount of densified carbon dioxide, said composition being essentially free of carbon dioxide soluble organic peracid.

In a second aspect of the invention a method to prepare the inventive composition is provided, characterised in that said method comprises the steps of a) mixing the low-active oxygen bleaching agent in a bleach-compatible solvent; and
b) mixing the solvent and low-active oxygen bleaching agent of step a) with the carbon dioxide.

In a third aspect of the invention a method is provided, comprising the following steps:

a) mixing a bleach-effective amount of a low-active oxygen bleaching agent in a bleach-compatible solvent, preferably an aqueous solvent; and
b) contacting said article with a bleaching composition according the invention, said composition comprising the resulting mixture of step a).

Preferably, the inventive composition and method is suitable to bleach articles in less than 45 min.

DETAILED DESCRIPTION OF THE INVENTION

The present invention is particularly advantageous for bleaching methods that require a short period of time. U.S. Pat. No. 5,431,843 describes bleaching times of 1 hour for effective stain removal. Unexpectedly we have now found that the present invention provides effective bleaching in 45 minutes or less. Another advantage of the present invention is the simplicity. Organic peracid precursors as described in the prior art often need a high pH to drive the perhydrolysis process. Since carbon dioxide has a low pH, special measures have to be taken to ensure the formation of relatively unstable peracids in a separate premix process. Furthermore, the low temperatures used in carbon dioxide cleaning will also slow this reaction. Yet another advantage of the present invention is the resistance to catalase present in soiled articles because the inventive composition and bleaching method are not based on hydrogen peroxide.

It is believed that the low-active oxygen bleaching agents are able to rapidly and effectively remove stains because these low-active oxygen bleaching agents do not need to be formed from an organic peroxyacid precursor and hydrogen peroxide. Instead, the low-active oxygen bleaching agents are added in their bleach reactive form. Consequently, another advantage of the present invention is that it is remarkably effective on a variety of stains, especially grass, tea and black currant stains. Without wishing to be bound by theory it is believed that because the inventive bleaching agents are insoluble in carbon dioxide, only minute amounts will be present in the carbon dioxide phase resulting in less dye damage.

The present invention is especially suitable to bleach and clean garments but may also be employed to bleach articles with hard surfaces.

For purposes of the invention, the following definitions are used:

"The bleaching composition" describes the total of the liquid carbon dioxide, the low-active oxygen bleaching agent, the modifier if present and optionally other additives.

"Carbon dioxide-soluble organic peracids" are those organic peracids that are soluble in carbon dioxide to greater than 0.001 wt % at pressures of about 101 kPa to 68.9 MPa and temperatures of from −78.5 to 100° C.

"Additives" are compounds to enhance the cleaning effect of the bleaching composition such as surfactants, whiteners, softeners, enzymes, perfume and antistat.

"Liquid carbon dioxide" means carbon dioxide which has a temperature of about 30° C. or less.

"Supercritical fluid carbon dioxide" means carbon dioxide which is at or above the critical temperature of 31° C. and the critical pressure of 7.2 Mpa (71 atmospheres) and which cannot be condensed into a liquid phase despite the addition of further pressure.

The term "densified carbon dioxide" encompasses both liquid and supercritical fluid carbon dioxide.

Bleaching composition

The bleaching composition is defined as the composition wherein the actual bleaching occurs analogous to a wash liquor. In practice this bleaching composition may be prepared by adding a bleaching product to the carbon dioxide analogous to adding a detergent product to the wash liquor.

The composition used in the inventive bleaching method is essentially free of carbon-dioxide soluble-organic peracid. For this purpose "essentially free" means that if present, these (trace) amounts of organic peracid should be so low that this compound does not significantly contribute to the bleaching effect compared to an identical bleaching composition free of said compound. Preferably these trace amounts should contribute less than 25%, more preferably less than 10% even more preferably less than 5% to the bleaching effect. For this test a grass stained test cloth, CS-8 (ex CFT) may be used. Generally, this will mean that less than 100 ppm, more preferably less than 10 ppm and most preferably less than 1 ppm of organic peracid is present in the bleaching composition used in the present invention. Preferably, the composition is also essentially free of organic peracids or precursors thereof.

Low-active Oxygen Bleaching Agent

For the present purpose, the term "low-active oxygen bleaching agent" is defined as those bleaching agents which have an active oxygen contents of less than 47% based on the pure undiluted bleaching compound. "Active oxygen" or "available oxygen" (AvO) is typically measured by standard methods such as iodide/thiosulfate and/or ceric sulfate titration. See Kirk Othmer's Encyclopaedia of Chemical Technology under "Bleaching Agents". AvO content of a bleach compound, usually expressed as a percent, is equal to 100×number of active Oxygen atoms×16/molecular weight of the oxygen bleach compound.

Although the applicants do not wish to be bound by theory, it is believed that the low-active oxygen bleaching agent act directly as the active bleaching species and not via the formation of hydrogen peroxide. Although during the bleach process with low-active oxygen bleach agents, some trace amounts of hydrogen peroxide may be formed, these amounts are not thought to contribute significantly to the bleaching effect. It is preferred that the inventive bleaching composition comprises of at most 100 ppm, most preferably, at most 10 ppm, even more preferred at most 1 ppm of hydrogen peroxide. Percarbonate and perborate are important sources of hydrogen peroxide and are not considered to be low-active oxygen bleaching agents according the invention, unlike bleaching agents such as peroxomonosulfate.

In most cases it is preferred that the low-active oxygen bleaching agent has the formula $$HOOX(=O)_n—W—Y;$$

Wherein:

X=selected from the group including carbon, sulfur, nitrogen, phosphorous and transition metals (e.g., Ti, V, Mn, Fe);

n=0, 1 or 2;

W=an organic or inorganic biradical or absent;

Y is selected from the group including $Z^+Z^-$ and a metal salt of deprotonated acid radical;

whereby $Z^+$=a radical having positively charged group, preferably selected from the group including ammonium and guanidinium $Z^-$=one or more negatively charged counterion(s), preferably selected from the group including sulfate, chloride, nitrate, fluoride, bromide, methylsulfonate, tolylsulfonate, and perchlorate.

Usually it is preferred that the metal salt of deprotonated acid radical is selected from the group including $—SO_3Na$, $—CO_2(Mg)0.5$ and $—PO_3(Na)_2$.

Preferably the low-active oxygen bleaching agent used in the present invention is selected from the group including peroxosulfates, peroxophosphates, chlorites, hypochlorites, peroxonitrites, peroxy-monophtalate, monoperoxysuccinate, 1-cholyl-percarbonate, para-(trimethylammoniummethyl)-perbenzoate and mixtures thereof. More preferably the low-active oxygen bleaching agent is selected from the group including peroxosulfates, peroxonitrites, chlorites, hypochlorites and mixtures thereof. Preferred salts of these low-active oxygen bleaching agents comprise positive ions including alkali metal and earth alkali metal ions. Particularly preferred low-active oxygen bleaching agents include alkali metal salts (Na, K) and alkali-earth metal salts (Mg, Ca) of peroxomonosulfate, hypochlorite, chlorite and mixtures thereof.

Preferred examples of low-active oxygen bleaching agent for use in the present invention include fluoride, chloride, bicarbonate, bisulfite, sulfate, methylsulphonate salts of 1-cholyl-percarbonate, para-(trimethylammoniummethyl)-perbenzoate.

According the invention a bleach-effective amount of an low-active oxygen bleaching agent is dissolved. The exact amount will depend on the volume of carbon dioxide, number of articles and nature and quantity of stains. The skilled person will be able to determine the bleach-effective amount without undue burden. Preferably, the low-active oxygen bleaching agent is present in the bleaching composition from 0.01 to 50 mM, more preferably, from 0.05 to 20 mM and even more preferably from 0.1 to 10 mM.

For the present purpose the bleaching agent may have any form known in the art. The form (for example crystal, powder, granulate) will depend on the required stability, processing and dissolution required. Preferred forms are those that easily dissolve or disperse in the bleach-compatible solvent. One preferred form is a particulate form wherein a particle size is chosen to obtain a good compromise between storage stability and convenient dissolution characteristics. Some inorganic bleaching agents such as sodium hypochlorite are commercially available as solutions and may also be used in present invention.

One of the most preferred low-active oxygen bleaching agents for the present invention is peroxosulfate, especially peroxomonosulfate.

Suitable peroxosulfate salts include any alkali metal peroxosulfate salt including sodium peroxosulfate salts and/or potassium peroxosulfate salts. Preferred peroxosulfate salt to be used herein is the monopersulfate salt. One of the most preferred low-active oxygen bleaching agents for the present invention is a water soluble peroxomonosulfate, normally an alkali metal peroxomonosulfate, such as potassium or sodium peroxomonosulfate. Potassium peroxomonosulfate, KHSO.sub.5, is available as the mixed salt 2KHSO.sub.5.KHSO.sub.4.K.sub.2 SO.sub.4, sold by E. I. DuPont DeNemours and Company, Inc. under the trademark Oxone™. That product has an active oxygen content of about 4.5%. The active oxygen content of the mixed salt described is about 5.2% when the salt is pure and the corresponding active oxygen content of KHSO.sub.5 is about 10.5%.

Thus, the pure mixed salt has half as much active oxygen in it as has the pure peroxomonosulfate and the 86.5% pure mixed salt (Oxone™) has 43% as much. In this specification when peroxomonosulfate is mentioned the single salt is intended, with its higher active oxygen content, but an equivalent proportion of the triple salt, such as that sold under the trademark Oxone, will normally be employed as the source of the active bleaching compound because of its ready availability, stability and desirable physical characteristics. Potassium peroxomonosulfate may also be named as potassium monopersulfate and its triple salt may also be considered to be a monopersulfate compound within the context of this invention.

Examples of monopersulfate salts commercially available are those commercialised by Interox under the trade name Curox™, by Degussa under the trade name Caroat™ or by DuPont under the trade name Oxone™. It is to be understood herein that when the commercially available Curox™, Caroat™ and/or Oxone™ are used, the % weights or molar amounts of peroxosulfate salts mentioned herein, refer to the total weight of said Curox™, Caroat™ and/or Oxone™. The active concentration is approximately ½ of the total weight. Other peroxosulfate salts such as dipersulfate salts commercially available among others from Peroxide Chemie GMBH can be used in the compositions according to the present invention. Another suitable persulphate salt is ammonium persulphate.

Surfactants

Preferably, the bleach composition according the invention comprises a surfactant. Any surfactant known to the person skilled in the art may be used. Surfactants are described in U.S. Pat. No. 5,789,505, U.S. Pat. No. 5,683,977, U.S. Pat. No. 5,683,473, U.S. Pat. No. 5,858,022 and WO 96/27704. Especially preferred are the surfactants described in WO 96/27704 (formula's I–IV).

With regard to the surfactants the following definitions will be used for the present invention. The term "densified carbon dioxide-philic" in reference to surfactants $R_nZ_m$ wherein n and m are each independently 1 to 50, means that the functional group, $R_n$— is soluble in carbon dioxide at pressures of from 101 kPa to 68.9 MPa and temperatures of from −78.5 to 100° C. to greater than 10 weight percent. Preferably n and m are each independently 1–35. Such functional groups ($R_n$—) include halocarbons, polysiloxanes and branched polyalkylene oxides.

The term "densified carbon dioxide-phobic" in reference to surfactants, $R_nZ_m$, means that $Z_m$— will have a solubility in carbon dioxide of less than 10 weight percent at pressures of from 101 kPa to 68.9 MPa and temperatures of from −78.5 to 100° C. The functional groups in $Z_m$— include carboxylic acids, phosphatyl esters, hydroxyls, $C_{1-30}$ alkyls or alkenyls, polyalkylene oxides, branched polyalkylene oxides, carboxylates, $C_{1-30}$ alkyl sulfonates, phosphates, glycerates, carbohydrates, nitrates, substituted or unsubstituted aryls and sulfates.

The hydrocarbon and halocarbon containing surfactants (i.e., $R_nZ_m$, containing the $CO_2$-philic functional group, $R_n$—, and the $CO_2$-phobic group, $Z_m$—) may have an HLB of less than 15, preferably less than 13 and most preferably less than 12.

The polymeric siloxane containing surfactants, $R_nZ_m$, also designated $MD_xD^*_yM$, with M representing trimethylsiloxyl end groups, $D_x$ as a dimethylsiloxyl backbone ($CO_2$-philic functional group) and $D^*_y$ as one or more substituted methylsiloxyl groups substituted with $CO_2$-phobic R or R' groups preferably have a $D_xD^*_y$ ratio of greater than 0.5:1, preferably greater than 0.7:1 and most preferably greater than 1:1.

A "substituted methylsiloxyl group" is a methylsiloxyl group substituted with a $CO_2$-phobic group R or R'. R or R' are each represented in the following formula:

$$—(CH_2)_a(C_6H_4)_b(A)_d—[(L)_e(A')_f]_n—(L')_gZ(G)_h$$

wherein a is 1–30, b is 0–1, $C_6H_4$ is substituted or unsubstituted with a $C_{1-10}$ alkyl or alkenyl and A, d, L, e, A', F, n L', g, Z, G and h are defined below, and mixtures of R and R'.

A "substituted aryl" is an aryl substituted with a $C_{1-30}$ alkyl, alkenyl or hydroxyl, preferably a $C_{1-20}$ alkyl or alkenyl.

A "substituted carbohydrate" is a carbohydrate substituted with a $C_{1-10}$ alkyl or alkenyl, preferably a $C_{1-5}$ alkyl. The terms "polyalkylene oxide", "alkyl" and "alkenyl" each contain a carbon chain which may be either straight or branched unless otherwise stated.

A preferred surfactant which is effective for use in a carbon dioxide bleach composition requires the combination of densified carbon dioxide-philic functional groups with densified carbon dioxide-phobic functional groups (see definitions above). The resulting compound may form reversed micelles with the $CO_2$-philic functional groups extending into a continuous phase and the $CO_2$-phobic functional groups directed toward the centre of the micelle.

The surfactant is preferably present in an amount of less than 10 wt % or more preferably of from 0.001 to 10 wt %, preferably 0.01 to 5 wt %. An especially preferred range is from about 0.03% to about 1 wt %.

If present, the $CO_2$-philic moieties of the surfactants are preferably groups exhibiting low Hildebrand solubility parameters, as described in Grant, D. J. W. et al. "Solubility Behavior of Organic Compounds", Techniques of Chemistry Series, J. Wiley & Sons, NY (1990) pp. 46–55 which describes the Hildebrand solubility equation, herein incorporated by reference. These $CO_2$-philic moieties also exhibit low polarisability and some electron donating capability allowing them to be solubilised easily in densified fluid carbon dioxide.

As defined above the $CO_2$-philic functional groups are soluble in densified carbon dioxide to greater than 10 eight percent, preferably greater than 15 weight percent, at pressures of from 101 kPa to 68.9 MPa and temperatures of from −78.5 to 100° C.

Preferred densified $CO_2$-philic functional groups include halocarbons (such as fluoro-, chloro- and fluorochlorocarbons), polysiloxanes and branched polyalkylene oxides.

The $CO_2$-phobic portion of the surfactant molecule is obtained either by a hydrophilic or a hydrophobic functional group which is less than 10 weight percent soluble in densified $CO_2$, preferably less than 5 wt. %, at a pressures of from 101 kPa to 68.9 MPa and temperatures of from −78.5 to 100° C. Examples of moieties contained in the $CO_2$-phobic groups include polyalkylene oxides, carboxylates, branched acrylate esters, $C_{1-30}$ hydrocarbons, aryls which are unsubstituted or substituted, sulfonates, glycerates, phosphates, sulfates and carbohydrates. Especially preferred $CO_2$-phobic groups include $C_{2-20}$ straight chain or branched alkyls, polyalkylene oxides, glycerates, carboxylates, phosphates, sulfates and carbohydrates.

Preferred surfactants comprise $CO_2$-philic and $CO_2$-phobic groups. The $CO_2$-philic and $CO_2$-phobic groups are preferably directly connected or linked together via a linkage group. Such groups preferably include ester, keto, ether, amide, amine, thio, alkyl, alkenyl, fluoroalkyl, fluoroalkenyl and mixtures thereof.

A preferred surfactant is:

$$R_nZ_m$$

wherein $R_n$— is a densified $CO_2$-philic functional group, R is a halocarbon, a polysiloxane, or a branched polyalkylene oxide and n is 1–50, and $Z_m$— is a densified $CO_2$-phobic functional group, and m is 1–50 and at pressures of 101 kPa to 68.9 MPa and temperatures of from −78.5 to 100° C., the $R_n$— group is soluble in the densified carbon dioxide to greater than 10 wt. percent and the $Z_m$— group is soluble in the densified carbon dioxide to less than 10 wt. percent.

Preferably, when R of the surfactant is the halocarbon or the branched polyalkylene oxide, then the surfactant has an HLB value of less than 15. In other cases it may be preferred that when R is the polysiloxane, then the surfactant has a ratio of dimethyl siloxyl to substituted methyl siloxy groups of greater than 0.5:1.

Surfactants which are useful in the invention may be selected from four groups of compounds (formula I-IV). The first group of compounds has the following formula:

$$[(CX_3(CX_2)_a(CH_2)_b)_c(A)_d-[(L)_e-(A')_f]_n-(L')_g]_oZ(G)_h \quad (I)$$

wherein X is F, Cl, Br, I and mixtures thereof, preferably F and Cl;

a is 1–30, preferably 1–25, most preferably 5–20;

b is 0–5, preferably 0–3;

c is 1–5, preferably 1–3;

A and A' are each independently a linking moiety representing an ester, a keto, an ether, a thio, an amido, an amino, a $C_{1-4}$ fluoroalkyl, a $C_{1-4}$ fluoroalkenyl, a branched or straight chain polyalkylene oxide, a phosphate, a sulfonyl, a sulfate, an ammonium and mixtures thereof;

d is 0 or 1;

L and L' are each independently a $C_{1-30}$ straight chained or branched alkyl or alkenyl or an aryl which is unsubstituted or substituted and mixtures thereof;

e is 0–3;

f is 0 or 1;

n is 0–10, preferably 0–5, most preferably 0–3;

g is 0–3;

o is 0–5, preferably 0–3;

Z is a hydrogen, a carboxylic acid, a hydroxy, a hosphate, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, (preferably $C_{1-25}$ alkyl), a carbohydrate unsubstituted or substituted with a $C_{1-10}$ alkyl or alkenyl (preferably a $C_{1-5}$ alkyl) or an ammonium; G is an anion or cation such as $H^+$, $Na^+$, $Li^+$, $K^+$, $NH_4^+Ca^{+2}$, $Mg^{+2}$; $Cl^-$, $Br^-$, $I^-$, mesylate, or tosylate; and h is 0–3, preferably 0–2.

Preferred compounds within the scope of the formula I include those having linking moieties A and A' which are each independently an ester, an ether, a thio, a polyalkylene oxide, an amido, an ammonium and mixtures thereof;

L and L' are each independently a $C_{1-25}$ straight chain or branched alkyl or unsubstituted aryl; and Z is a hydrogen, carboxylic acid, hydroxyl, a phosphate, a sulfonyl, a sulfate, an ammonium, a polyalkylene oxide, or a carbohydrate, preferably unsubstituted. G groups which are preferred include $H^+$, $Li^+$, $Na^+$, $NH^+_4$, $Cl^-$, $Br^-$ and tosylate.

Most preferred compounds within the scope of formula I include those compounds wherein A and A' are each independently an ester, ether, an amido, a polyoxyalkylene oxide and mixtures thereof; L and L' are each independently a $C_{1-20}$ straight chain or branched alkyl or an unsubstituted aryl; Z is a hydrogen, a phosphate, a sulfonyl, a carboxylic acid, a sulfate, a poly(alkylene oxide) and mixtures thereof; and G is $H^+$, $Na^+$ or $NH_4^+$.

Compounds of formula I are prepared by any conventional preparation method known in the art such as the one described in March, J., "Advanced Organic Chemistry", J. Wiley & Sons, NY (1985).

Commercially available fluorinated compounds include compounds supplied as the Zonyl™ series by Dupont.

The second group of surfactants useful in the bleach composition are those compounds having a polyalkylene moiety and having a formula (II).

$$[H-[CH(R)-CH(R')-O]_i-(A)_d-[(L)_e-(A')_f]_n-(L')_g]_oZ(G)_h \quad (II)$$

wherein R and R' each represent a hydrogen, a $C_{1-5}$ straight chained or branched alkyl or alkylene oxide and mixtures thereof;

i is 1 to 50, preferably 1 to 30, and

A, A', d, L, L', e f, n, g, o, Z, G and h are as defined above.

Preferably R and R' are each independently a hydrogen, a $C_{1-3}$ alkyl, or alkylene oxide and mixtures thereof.

Most preferably R and R' are each independently a hydrogen, $C_{1-3}$ alkyl and mixtures thereof. Non-limiting examples of compounds within the scope of formula II are described in WO 96/27704.

Compounds of formula II may be prepared as is known in the art and as described in March et al., Supra.

Examples of commercially available compounds of formula II may be obtained as the Pluronic series from BASF, Inc.

A third group of surfactants useful in the invention contain a fluorinated oxide moiety and the compounds have a formula:

$$[(CX_3(XO)_r(T)_s)_c(A)_d—[(L)_e—(A')_f—]_n(L')_g]_oZ(G)_h \quad \text{(III)}$$

wherein XO is a halogenated alkylene oxide having $C_{1-6}$ straight or branched halocarbons, preferably $C_{1-3}$, r is 1–50, preferably 1–25, most preferably 5–20, T is a straight chained or branched haloalkyl or haloaryl, s is 0 to 5, preferably 0–3, X, A, A', c, d, L, L', e, f, n, g, o, Z, G and h are as defined above.

Examples of commercially available compounds within the scope of formula III include those compounds supplied under the Krytox™ series by DuPont having a formula:

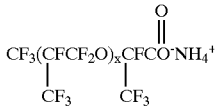

wherein x is 1–50.

Other compounds within the scope of formula III are made as known in the art and described in March et al., Supra.

The fourth group of surfactants useful in the invention include siloxanes containing surfactants of formula IV $$MD_xD^*_yM \quad \text{(IV)}$$

wherein M is a trimethylsiloxyl end group, $D_x$ is a dimethylsiloxyl backbone which is $CO_2$-philic and $D^*_y$ is one or more methylsiloxyl groups which are substituted with a $CO_2$-phobic R or R' group, wherein R and R' each independently have the following formula:

$$(CH_2)_a(C_6H_4)_b(A)_d—[(L)_e—(A')_f—]_n—(L')_gZ(G)_h$$

wherein a is 1–30, preferably 1–25, most preferably 1–20, b is 0 or 1, $C_6H_4$ is unsubstituted or substituted with a $C_{1-10}$ alkyl or alkenyl, and A, A', d, L, e, f, n, L', g, Z, G and h are as defined above and mixtures of R and R' thereof.

The $D_x$:$D^*_y$ ratio of the siloxane containing surfactants should be greater than 0.5:1, preferably greater than 0.7:1 and most preferably greater than 1:1.

The siloxane compounds should have a molecular weight ranging from 100 to 100,000, preferably 200 to 50,000, most preferably 500 to 35,000.

Silicones may be prepared by any conventional method such as the method described in Hardman, B. "Silicones" the *Encyclopaedia of Polymer Science and Engineering*, v. 15, 2nd Ed., J. Wiley and Sons, NY, N.Y. (1989).

Examples of commercially available siloxane containing compounds which may be used in the invention are those supplied under the ABIL series by Goldschmidt.

Suitable siloxane compounds within the scope of formula IV are compounds of formula V:

(V)

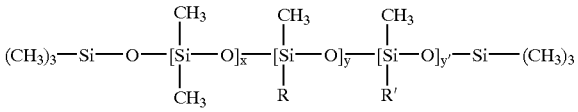

the ratio of x:y and y' is greater than 0.5:1, preferably greater than 0.7:1 and most preferably greater than 1:1, and R and R' are as defined above.

Preferred $CO_2$-phobic groups represented by R and R' include those moieties of the following formula:

$$(CH_2)_a(C_6H_4)_b(A)_d—[(L)_e—(A')_f—]—(L')_gZ(G)_h$$

wherein a is 1–20, b is 0, $C_6H_4$ is unsubstituted,

A, A', d, L, e, f, n, g, Z, G and h are as defined above, and mixtures of R and R'.

Particularly useful surfactants are selected from the group consisting of the classes of ethoxy modified polydimethylsiloxanes (e.g. Silwet™ surfactants from Witco), acetylenic glycol surfactants (from Air Products) and ethoxy/propoxy block copolymers (e.g. Pluronic™ surfactants from BASF) and mixtures thereof.

Bleach-Compatible Solvent

The inventive bleach composition also comprises a bleach-compatible solvent. The type of solvent will depend on the exact nature of the bleaching agent. If the bleaching agent is more or less hydrophobic then a hydrophobic fluid may be preferred. Alternatively if the organic substance is more or less hydrophilic, a hydrophilic fluid may be preferred. In many cases it will be preferable, to dissolve or to disperse the bleaching agent in an aqueous solvent such as water. Preferred amounts of compatible solvent should be from 0.0001 to about 10 wt % (weight/weight of the carbon dioxide), more preferably 0.001 to about 5 wt %, even more preferably 0.01 to about 3 wt %, most preferably from about 0.05 to about 0.2 wt %. Preferred solvents include water, ethanol, acetone, hexane, methanol, glycols, acetonitrile, $C_{1-10}$ alcohols and $C_{5-15}$ hydrocarbons. Especially preferred solvents include water, ethanol and methanol.

Modifier

In addition to the bleach-compatible solvent, it may be desirable to include a modifier in the bleaching composition, such as water, or an organic solvent up to only about 10 wt %, and additives to boost the bleaching and or cleaning performance such as enzymes up to about 10 wt %, surfactants, perfumes, and antistats.

In a preferred embodiment, a modifier such as water, or a useful organic solvent may be added with the stained cloth in the cleaning drum in a small volume. Preferred amounts of modifier should be from 0.0 to about 10 wt % (weight/weight of the liquid $CO_2$), more preferably 0.001 to about 5 wt %, even more preferably 0.01 to about 3 wt %, most preferably from about 0.05 to about 0.2 wt %. Preferred solvents include water, ethanol, acetone, hexane, methanol, glycols, acetonitrile, $C_{1-10}$ alcohols and $C_{5-15}$ hydrocarbons. Especially preferred solvents include water, ethanol and methanol. If the modifier is water, optionally 0.1 to 50% of an additional organic cosolvent may be present as described in U.S. Pat. No. 5,858,022. In those circumstances it may be preferred to use surfactants as described in U.S. Pat. No. 5,858,022 which do contain a $CO_2$ philic group.

Method of Preparing the Bleaching Composition

The method to prepare the inventive composition is characterised in that said method comprises the steps of a) mixing the low-active oxygen bleaching agent in a bleach-compatible solvent; and b) mixing the solvent and low-active oxygen bleaching agent of step a) with the carbon dioxide.

The compatibility of the solvent will depend on the exact nature of the bleaching agent as indicated above. In many cases it will be preferable, to dissolve or to disperse the bleaching agent in an aqueous solvent. A particularly preferred solvent is water. Usually the best results are achieved when substantially most of the bleaching agent is dissolved although in some cases some of the bleaching agent may still be dispersed.

In contrast to organic precursors such as TAED, we have found that low-active oxygen bleaching agents as peroxomonosulphate dissolve very quickly in water. Preferably the bleaching agent is mixed with the solvent for less than 5 min, more preferably less than 3 min, even more preferably less than 1 min immediately prior to mixing the bleaching agent with the carbon dioxide. In addition, the low-active oxygen bleaching agent dissolves rapidly without the need to adjust the pH. Preferably, the low-active oxygen bleaching agent is mixed with pH neutral solvent such as water.

Method of Bleaching

The inventive bleaching method may be used in cleaning systems with carbon dioxide such as described in U.S. Pat. No. 5,683,473, U.S. Pat. No. 5,676,705, U.S. Pat. No. 5,683,977, U.S. Pat. No. 5,881,577, U.S. Pat. No. 5,158,704, U.S. Pat. No. 5,266,205, U.S. Pat. No. 5,858,022 and the references cited therein. According the present invention an effective dry cleaning amount of densified carbon dioxide is used. The exact amount will depend on the volume of the vessel, pressure at which the dry cleaning is performed, number of articles and nature and quantity of stains. The skilled person will be able to determine effective dry cleaning amount of densified carbon dioxide without undue burden using the references above. Usually, the amount of carbon dioxide will correspond to a volume of from 0.1 and 500 liter, more preferably of from 0.2 to 100 liter at the operating pressure and temperature.

The bleaching method may be used to bleach and/or clean any suitable article. The items to be cleaned should be compatible with the liquid carbon dioxide. Preferably, the items include garments and domestic articles with hard surfaces. The bleaching method is especially useful to clean textile articles with bleachable stains, in particular those with grass stains.

According the invention, the method to bleach articles is characterised in that said method comprises the following steps:

a) mixing a bleach-effective amount of a low-active oxygen bleaching agent in a bleach-compatible solvent, preferably an aqueous solvent; and b) contacting said article with a bleaching composition according the invention, said composition comprising the resulting mixture of step a).

Usually, the method of bleaching comprises loading a variety of soiled articles, preferably clothing, into a vessel (preferably a pressurisable vessel) and contacting the articles with the bleaching composition comprising the low-active oxygen bleaching agent. The bleaching composition minus the carbon dioxide may be contacted with the soiled articles before or together with the carbon dioxide. The carbon dioxide may be introduced into the cleaning vessel as described in U.S. Pat. No. 5,683,473. Preferably, the carbon dioxide is introduced into the cleaning vessel which is then pressurised to a pressure in the range of about 0.1 to about 68.9 MPa and adjusted to a temperature range of from about −78.5° C. up to about 100° C. Although it may not always be desirable, the bleaching method may be carried out in supercritical carbon dioxide where the temperature is between 31° C. and 100° C., preferably between 31° C. and 60° C. Often it is preferred that the carbon dioxide is in a liquid phase so the temperature is held at −78.5° C. up to about 30° C. Preferably the pressure range is from 0.5 to 48 MPa, more preferably from 2.1 to 41 MPa. Preferably, the temperature range is from −56.2 to 25° C., more preferably from −25° C. to 20° C. After the bleaching step, the articles may be rinsed by introducing fresh carbon dioxide into the vessel after removing the bleaching composition.

It is noted that other densified molecules having supercritical properties may also be employed alone or in mixture. These molecules include methane, ethane, propane, ammonia, butane, n-pentane, n-hexane, cyclohexane, n-heptane, ethylene, propylene, methanol, ethanol, isopropanol, benzene, toluene, p-xylene, sulfur dioxide, chlorotrifluoromethane, xenon trichlorofluoromethane, perfluoropropane, chlorodifluoromethane, sulfur hexafluoride and nitrous oxide.

As described above, one of the advantages of the present invention is that very short bleaching times are needed to obtain good bleaching. Preferably, the articles are contacted with the bleaching composition for less than 45 min, more preferably less than 35 min, most preferably less 25 min.

The inventive bleaching method may be used in densified carbon dioxide although in some case liquid carbon dioxide may be preferred.

Other than in the examples, or where otherwise indicated, all numbers expressing quantities of ingredients or reaction conditions used herein are to be understood as modified in all instances by the term "about". Similarly, all percentages are weight/weight percentages of the carbon dioxide unless otherwise indicated. Where the term "comprising" is used in the specification or claims, it is not intended to exclude any terms, steps or features not specifically recited.

The invention is more fully illustrated by the following non-limiting examples showing some preferred embodiments of the invention.

EXAMPLES

Example 1

Commercially available, bleach sensitive test cloths BC-1, CS-8 and CS-12 were dry cleaned using liquid carbon dioxide, hydrogen peroxide, low-active oxygen bleaching agents and mixtures thereof according to the invention.

BC-1 is a tea stained test cloth; CS-8 is a grass stained test cloth; CS-12 is a black currant stained test cloth;

all are made by CFT. Four 2"×2" swatches of a given stain cloth were placed in a 600 ml autoclave having a gas compressor, an extraction system and a stirrer. The cloths were allowed to move freely in the autoclave. Good agitation was ensured by visual observation with an endoscope through a small sapphire window in the autoclave. After placing the cloths in the autoclave and sealing it, liquid $CO_2$ at a tank pressure of 5.86 Mpa was allowed into the system and was cooled to reach a temperature of about 12° C. at which point the liquid $CO_2$ was at a pressure of about 5.52 MPa. The stirrer was then turned on for 15 minutes to mimic a wash cycle. At the completion of the wash cycle, 20 cubic feet (566 liter) of fresh $CO_2$ were passed through the system to mimic a rinse cycle. The pressure of the autoclave was then released to atmospheric pressure and the cleaned cloths were removed from the autoclave. Two runs were performed with each system tested. To measure the extent of cleaning, the cloths were placed in a Reflectometer supplied by Colorguard. The R scale, which measures the reflection of light at 460 nm, was used to determine stain removal. Cleaning results were reported as the percent stain removal according to the following calculation:

$$\%\ \text{stain removal} = \frac{\text{stain removed}}{\text{stain applied}} = \frac{\text{cleaned cloth reading} - \text{stained cloth reading}}{\text{unstained cloth reading} - \text{stained cloth reading}} \times 100\%$$

Potassium peroxosulfate (Caroat™; MW=615) was mixed in water wherein it dissolved in less than 1 min such that dosing 1 ml of stock solution into the autoclave yielded a 2 mM w/v (weight/volume of liquid $CO_2$) concentration. For the hydrogen peroxide control, a concentration of 10 mM was used and delivered from 30% active solution.

Bleaching results on the stained cloths are shown in Table 1 below.

TABLE 1

Bleach Results using Caroat (Peroxosulfate Bleach) at 2 mM

| Bleach Composition | % Soil Removal BC-1 | CS-8 | CS-12 |
|---|---|---|---|
| $CO_2$ alone | −3 | 1 | 0 |
| $CO_2$ + Hydrogen peroxide | 26 | 13 | 33 |
| $CO_2$ + Caroat | 61 | 52 | 61 |

The results show that when the peroxosulfate salt is used, excellent bleaching results on these bleach sensitive cloth are obtained. The bleaching from the peroxosulfate salt at one-fifth the concentration is consistently better than that obtained with hydrogen peroxide. Similar results were obtained in a separate experiment where the wash cycle was only 5 min. The stain removal with the low-active oxygen bleaching agent was considerably better compared to the results of a separate experiment wherein a combination of H2O2 and an organic peracid precursor was used.

Example 2

In Table 2 is shown a bleaching composition which is useful within the scope of this invention.

TABLE 2

| Ingredient | Concentration |
|---|---|
| Caroat | 2 mM |
| Silwet L-7602* | 0.05% (w/v) |
| Water | 0.1% (w/v) |

*Silwet L-7602 is an organosilicone surfactant from Witco.

Example 3

In Table 3 is shown a bleaching composition which is useful within the scope of this invention.

TABLE 3

| Ingredient | Concentration |
|---|---|
| Caroat | 2 mM |
| Pluronic L-62* | 0.05% (w/v) |
| Water | 0.1% (w/v) |

*Pluronic L-62 is an ethoxy/propoxy block copolymer from BASF.

Example 4

In Table 4 is shown a bleaching composition which is useful within the scope of this invention.

TABLE 4

| Ingredient | Concentration |
|---|---|
| Caroat | 2 mM |
| Surfynol 440* | 0.05% (w/v) |
| Water | 0.1% (w/v) |

*Surfynol 440 is an ethoxy-modified tertiary acetylenic glycol surfactant from Air Products.

Example 5

In Table 5 is shown a bleaching composition which is useful within the scope of this invention.

TABLE 5

| Ingredient | Concentration |
|---|---|
| Sodium peroxonitrite | 2 mM |
| Silwet L-7602* | 0.05% (w/v) |
| Water | 0.1% (w/v) |

*Silwet L-7602 is an organosilicone surfactant from Witco.

Example 6

The bleaching effect of a carbon dioxide insoluble organic peracid magnesium peroxy-monophtalate hexahydrate (PMP) was investigated in the experimental set-up as described for Example 1. In the first experiment 0.742 g of PMP was mixed with the carbon dioxide to result in a concentration 2 mM w/v (weight/volume of liquid $CO_2$) PMP. In a second experiment the same amount of PMP was first mixed with 4 ml of demineralised water for 30 sec. Subsequently the resultant mixture was mixed with the carbon dioxide to result in a concentration 2 mM PMP. In the second experiment soil removal for CS-12 testcloth was excellent and considerably better compared to the result of the first experiment.

What is claimed is:

1. A bleaching composition comprising a) a bleach-effective amount of a tow-active oxygen bleaching agent wherein said low-active oxygen bleaching agent has an active oxygen content of less than 47% based on the pure undiluted bleaching compound, and which is not hydrogen peroxide, a chlorite or a hypochiorite;

b) a bleach-compatible solvent c) 0 to 10 wt % of a surfactant;

d) less than 10 wt % of a modifier; and e) an effective dry cleaning amount of densified carbon dioxide, said composition being essentially free of carbon dioxide soluble organic peracid.

2. A composition according to claim 1, characterised in that the bleaching agent is selected from the group including peroxosutfates, peroxophosphates, peroxonitrites, peroxymonophthalate, monoperoxysuccinate, 1-cholylpercarbonate, para-(trimethylammoniummethyl)-perbenzoate and mixtures thereof.

3. A composition according to claim 2, characterised in that the bleaching agent is selected from the group consisting of peroxosulfates, peroxophosphates, and mixtures thereof.

4. A composition according to claim 1, characterised in that composition comprises from 0.01 mM to 50 mM of the bleaching agent.

5. A composition according to claim 1, characterised in that the composition comprises from 0.001 to 10 wt % of a surfactant.

6. A composition according to claim 5, characterised in that the surfactant is represented by a formula $$R_nZ_m$$

wherein $R_n$ is a densified $CO_2$-philic functional group, R is a halocarbon, a polysiloxane, or a branched polyalkylene oxide and n is 1–50;

$Z_m$— is a densified $CO_2$-phobic functional group and m is 1–50; and at pressures of 101 kPa to 68.9 MPa and temperatures of from −78.5 to 100° C., the Rn- group is soluble in the densified carbon dioxide to greater than 10 wt. percent and the Zm- group is soluble in the densified carbon dioxide to less than 10 wt. percent.

7. A composition according to claim 6, characterised in that the surfactant is selected from surfactants whereof the $CO_2$-philic and $CO_2$-phobic groups are directly connected or linked together via a linkage group, said linkage group being selected from ester, keto, ether, amide, amine, thio, alkyl, alkenyl, fluoroalkyl, fluoroalkenyl and mixtures thereof.

8. A composition according to claim 5, characterised in that the surfactant is selected from the group consisting of ethoxy modified polydimethylsiloxanes, acetylenic glycol surfactants, ethoxy/propoxy block copolymers and mixtures thereof.

9. A composition according to claim 1, characterised in that the composition comprises 0.001 to about 5 wt % of a modifier.

10. A method to bleach articles characterised in that said method comprises the following steps:

a) mixing a bleach-effective amount of a low-active oxygen bleaching agent in a bleach-compatible solvent; and b) contacting said article with a bleaching composition according to claim 1, said composition comprising the resulting mixture of step a).

11. A method according to claim 10 characterised in that the article is contacted with the composition for less than 45 min.

12. A method according to claim 10 wherein the articles are textile articles with grass stains.

* * * * *